US009110485B2

(12) United States Patent
Sicard

(10) Patent No.: US 9,110,485 B2
(45) Date of Patent: Aug. 18, 2015

(54) BAND-GAP VOLTAGE REFERENCE CIRCUIT HAVING MULTIPLE BRANCHES

(75) Inventor: Thierry Sicard, Tournefeuille (FR)

(73) Assignee: Freescale Semiconductor, Inc., Austin, TX (US)

( * ) Notice: Subject to any disclaimer, the term of this patent is extended or adjusted under 35 U.S.C. 154(b) by 388 days.

(21) Appl. No.: 12/675,252

(22) PCT Filed: Sep. 21, 2007

(86) PCT No.: PCT/IB2007/054337
§ 371 (c)(1),
(2), (4) Date: Feb. 25, 2010

(87) PCT Pub. No.: WO2009/037532
PCT Pub. Date: Mar. 26, 2009

(65) Prior Publication Data
US 2010/0308788 A1 Dec. 9, 2010

(51) Int. Cl.
*G05F 3/30* (2006.01)

(52) U.S. Cl.
CPC ..... *G05F 3/30* (2013.01)

(58) Field of Classification Search
CPC ..... G05F 3/30; G05F 3/26
USPC ..... 323/311–315, 317, 907; 327/538–543
See application file for complete search history.

(56) References Cited

U.S. PATENT DOCUMENTS 4,349,778 A 9/1982 Davis
4,422,033 A * 12/1983 Minner et al. ..... 323/314
4,524,318 A * 6/1985 Burnham et al. ..... 323/313
4,525,663 A * 6/1985 Henry ..... 323/280
5,081,410 A 1/1992 Wood
6,172,555 B1 1/2001 Gusinov
6,342,781 B1 * 1/2002 Laraia ..... 323/313
6,788,041 B2 9/2004 Gheorghe et al.
7,075,282 B2 7/2006 Feng
2005/0035813 A1 2/2005 Xi
2005/0122091 A1 6/2005 Marinca
2005/0151528 A1 7/2005 Marinca
2005/0242799 A1 * 11/2005 Erdelyi et al. ..... 323/312

FOREIGN PATENT DOCUMENTS

WO 98/35282 A 8/1998

OTHER PUBLICATIONS

IEEE, 2000, IEEE Std 100-2000, p. 116.*
(Continued)

*Primary Examiner* — Jessica Han
*Assistant Examiner* — Gustavo Rosario Benitez

(57) ABSTRACT

A band-gap voltage reference circuit having first and second branches respectively including first and second groups of transistors of different emitter current conduction areas and current sources for running the first and second groups of transistors at different emitter current densities to generate respective base-emitter voltages, and output terminals connected to receive a regulated voltage (Vout) which is a function of the base-emitter voltages of the first and second groups of transistors. Each of the first and second groups includes at least one npn-type transistor and at least one pnp transistor connected with their emitter-collector paths in series in the respective one of the branches so as to present cumulated base-emitter voltages across the respective group.

12 Claims, 6 Drawing Sheets

(56) References Cited

OTHER PUBLICATIONS

Tausch J et al: "Analysis of Bipolar Linear Circuit Response Mechanisms for High and Low Dose Rate Total Dose Irradiations" Tions on Nuclear Science, IEEE Service Center, New York, NY, US, vol. 43, No. 6, Dec. 1, 1996.

Brokaw A P: "A Simple Three-Terminal IC Bandgap Reference" IEEE Journal of Solid-State Circuits, IEEE Service Center, Piscataway, NJ, US, vol. 9, No. 6, Dec. 1, 1974.

Horn Wolfgang et al: "A Robust Smart Power Bandgap Reference Circuit for Use in an Automotive Environment" IEEE Journal of Solid-State Circuits, vol. 37, No. 17, Jul. 2002.

Rahajandraibe W. et al: "Very Low Power High Temperature Stability Bandgap Reference Voltage" ESSCIRC 2002.

Malcovati Piero et al: "Curvature-Compensated BiCMOS Bandgap with 1-V Supply Voltage" IEEE Journal of Solid-State Circuits, vol. 36, No. 7, Jul. 2001.

Gunawan Made et al: "A Curvature-Corrected Low-Voltage Bandgap Reference" IEEE Journal of Solid-State Circuits, vol. 28, No. 6, Jun. 1993.

* cited by examiner

BAND-GAP VOLTAGE REFERENCE CIRCUIT HAVING MULTIPLE BRANCHES

FIELD OF THE INVENTION

This invention relates to a band-gap voltage reference circuit.

BACKGROUND OF THE INVENTION

A widely used voltage reference supply is a band-gap circuit, which has typically been used to provide a low reference voltage with stability in the presence of temperature variations and noise or transients. In one form of band-gap circuit, known as a Brokaw circuit and described in the article "A simple Three-Terminal IC Bandgap Reference" in IEEE Journal of Solid-State Circuits, vol. SC9, n° 6, December 1974, two groups of junction-isolated bipolar transistors run at different emitter current densities. The difference in emitter current densities produces a related difference between the base-emitter voltages of the two groups. This voltage difference is added to the base-emitter voltage of the transistor with higher emitter current density with a suitable ratio defined by a voltage divider. The temperature coefficient of the base-emitter voltage is negative and tends to compensate the positive temperature coefficient of the voltage difference.

A Brokaw band-gap circuit exhibits good stability and accuracy compared with other known circuits but still suffers from residual process dispersion, variability and temperature drift caused, for example, by mismatch of the mirror currents and base currents, especially when PNP transistors are used, which have low beta (collector-to-base current gain). PNP vertical transistors are preferred however for low power applications, to reduce parasitic effects in NPN vertical transistor integrated circuits, where parasitic horizontal transistor structures are formed by the different buried PN junctions, and high frequency current injection occurs due to DPI (direct power injection), with high frequency currents induced in the transistor collectors by parasitic capacitances at the buried PN junctions.

Especially, a standard Brokaw band-gap circuit also suffers from some inaccuracies due to dispersion of parameters due to manufacturing tolerances. While some of these sources of errors can be corrected during manufacturing, for example by trimming the products, such corrective actions do not give optimal results and increase manufacturing cost. It is desirable to reduce the sources of reference voltage inaccuracy in reference voltage circuits and also to ensure low quiescent current sustaining parasitic high frequency injected in the power supply.

The present invention addresses some or all of these issues.

The article "A curvature-corrected low-voltage bandgap reference" by Gunawan, M.; Meijer, G. C. M.; Fonderie, J.; Huijsing, J. H.; in the IEEE Journal of Solid-State Circuits Volume 28, Issue 6, June 1993 Page(s): 667-670 and US patent specifications 20050122091, 5081410, 20050035813 and 6172555 describes various derivatives of the Brokaw circuit.

SUMMARY OF THE INVENTION

The present invention provides electrical supply apparatus as described in the accompanying claims.

DETAILED DESCRIPTION OF THE PREFERRED EMBODIMENTS

Figure 1:
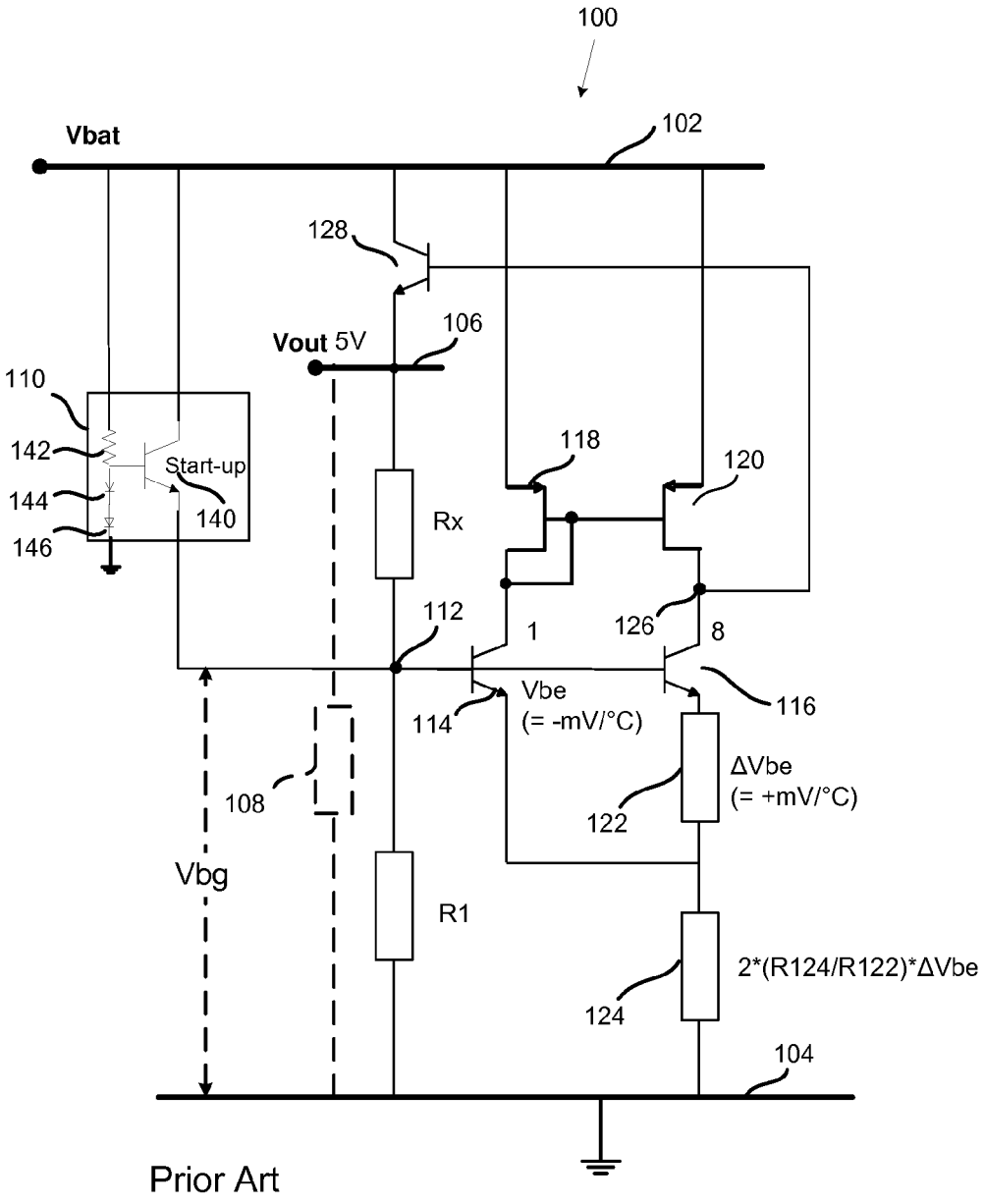
FIG. 1 is a schematic diagram of one configuration of a known band gap reference voltage circuit.

FIG. 1 shows an example of an output circuit 100 in a known voltage regulator. The voltage regulator shown in FIG. 1 comprises a rail 102 supplied from a source of power, in this case a battery, not shown, with a voltage Vbat relative to ground 104. The voltage Vbat will typically be 12 volts but may be up to 40 volts in some automotive applications, for example. The voltage regulator 100 supplies an output voltage Vout, which is 5 volts in this example, on an output rail 106 to a load 108.

Voltage from the battery rail 102 is supplied through a start-up circuit 110 to a node 112 between two resistors Rx and R1, which are connected in series with the resistor Rx connected to the output rail 106 and the resistor R1 connected to ground 104. The node 112 is connected to common bases of a pair of npn transistors 114 and 116, whose collectors are connected through P-type metal-oxide-Silicon ('Pmos') FETs 118 and 120 respectively to the output rail 106. The emitter current density of the transistor 116 is substantially larger than that of the transistor 114, in this case a factor of 8 times. The FETs 118 and 120 are coupled in a current mirror configuration, with their gates connected together and to the drain of FET 118 and their sources connected to the power supply rail 102. The emitter of transistor 116 is connected through a resistor 122 and then a resistor 124 in series to ground 104 and the emitter of transistor 114 is connected to the common point between resistors 122 and 124 and therefore through the resistor 124 to ground. The connection 126 between the collector of transistor 116 and FET 120 is connected to the base of a transistor 128, whose collector is connected to the battery rail 102 and whose emitter is connected to the output rail 106.

The start-up circuit 110 in the voltage regulator shown in FIG. 1 is a known type of circuit, comprising an npn transistor 140 whose collector is connected to the battery supply line 102, whose emitter is connected to the node 112 and whose base is connected through a resistor 142 to the battery supply line 102 and through two forward biased diodes 144 and 146 in series to ground.

In normal operation, the transistor 128 provides current to the bases of transistors 114 and 116, whose common base voltage rises, and the current in the transistor 114 increases until its emitter voltage has risen sufficiently for its base-emitter voltage Vbe to exceed its threshold voltage. The current mirror formed by FETs 118 and 120 drives the transistor 128 to stabilise the common base voltage of the transistors 114 and 116 to a value such that the currents are equal in transistors 114 and 116. The voltage divider formed by resistors Rx and R1 ensures that the voltage Vbe appearing across the base-emitter of the transistor 114 is multiplied by a chosen factor K to produce Vout=Vbg*(Rx+R1)/R1, where Vbg is the voltage between the node 112 and ground. In the example shown, the factor K is chosen to be 4.17, multiplying the voltage Vbg for Silicon transistors of 1.2 volts so that Vout equals 5.0 volts. The resistors R1, Rx, 122 and 124 present resistances that vary similarly with temperature, so that their ratio remains constant independently of temperature.

In more detail, the difference in current densities in the base-emitter junctions of the transistors 114 and 116 produces different base-emitter voltages in the transistors 114 and 116, so that the difference, ΔVbe, appearing across the resistor 122 is given by:

$$\Delta Vbe = \frac{kT}{q}\log n\frac{J114}{J116},$$

where k is the Boltzmann constant, T is the absolute temperature, q is the fundamental electron charge and J114 and J116 are the respective emitter current densities of the transistors 114 and 116, the current density J114 being chosen to be 8 times that of J116 in the example shown. Since the currents in transistors 114 and 116 are equal, the current in resistor 124 is twice that in resistor 122, so that the voltage across the resistor 124 is:

$$2\frac{R124}{R122}\frac{kT}{q}\log n\frac{J114}{J116}.$$

The voltage Vbg is the sum of this voltage, approximately 0.6 volts at room temperature and which varies positively with temperature and the base-emitter voltage Vbe of the transistor 116, also approximately 0.6 volts at room temperature and which varies negatively with temperature, so that $$Vbg = Vbe + 2\frac{R124}{R122}\frac{kT}{q}\log n\frac{J114}{J116}.$$

The resistances of 122 and 124 and the junction current densities J114 and J116 are chosen so that the negative coefficient of temperature variation of the voltage Vbe (in this example approximately −2 mV/° K) cancels the positive coefficient of temperature variation of the voltage difference ΔVbe (in this example approximately +2 mV/° K), to a first order of approximation. The voltage Vbg, and hence the voltage Vout is thus regulated to be substantially independent of variations in power supply voltage Vbat.

The parameters of the voltage regulator of FIG. 1 are chosen so that it ought to be self-starting. However, there remains a risk that the circuit will not start by itself, due to various circumstances including unfavourable manufacturing variances and/or slow build up of the power voltage, for example. In particular, it is sufficient for one of the transistors 114 or 116 or the FETs 118 or 120 of the current mirror to fail to conduct for the non-conducting element to block the others and to prevent the voltage Vout from being established.

The start-up circuit 110 ensures that operation of the regulator voltage output circuit 100 starts-up reliably when first connected to a source of power through the line 102. However, there remains substantial residual current flow through the diodes 144 and 146 even after the voltage regulator output circuit 100 is functioning normally or is in quiescent mode. Our co-pending patent application PCT/FR2007/051713 describes an improved start-up circuit, which enables residual current flow in the start-up circuit to be reduced to very low levels once the voltage regulator output circuit 100 is functioning normally or is in quiescent mode.

Figure 2:
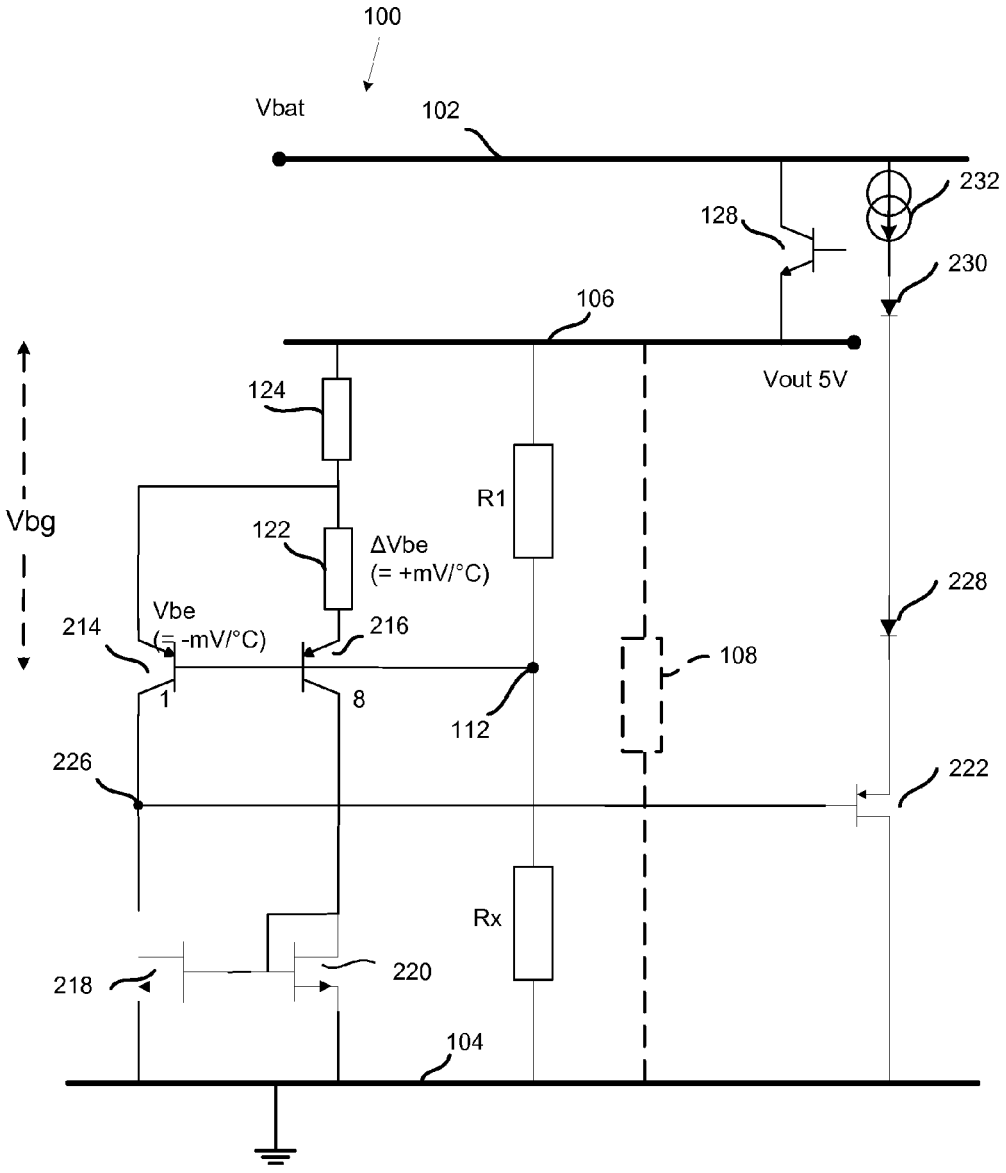
Prior Art Figure 2
FIG. 2 is a schematic diagram of another configuration of a known band gap reference voltage circuit.

FIG. 2 shows a variant of the output circuit 100 of FIG. 1, in which the configuration of pnp bipolar transistors 214, 216 and N-type FETs 218, 220 is inverted compared to the npn bipolar transistors 114, 116 and the P-type FETs 118, 120 of FIG. 1. The other components have the same reference numerals as the corresponding components in FIG. 1. The sources of the FETs 218 and 220 are connected to ground 104 and their drains are connected to the collectors of the transistors 214 and 216 respectively. The emitter of transistor 216 is connected through the resistor 122 and then the resistor 124 in series to the Vout rail 106 and the emitter of transistor 214 is connected to the common point between resistors 122 and 124 and therefore through the resistor 124 to the Vout rail 106. A P-type FET 222 has its gate connected to the connection 226 between the collector of transistor 214 and the FET 218, its drain connected to ground 104 and its source connected to the battery rail 102 through the series connections of forward biased diodes 228 and 230 and a current source 230. The connection between the diode 230 and the current source 232 is connected to control the voltage applied to the base of the transistor 128 supplying power from the battery rail 102 to the output rail 106, the diodes 228 and 230 compensating the base-emitter voltages of transistors 128 and 216. A start-up circuit (not shown) is also necessary to ensure reliable starting of this variant of the voltage regulator.

In normal operation, the transistor 128 provides current to the bases of transistors 214 and 216, whose common base voltage adjusts so that the current in the transistor 214 increases until its base-emitter voltage Vbe exceeds its threshold voltage. The current mirror formed by FETs 218 and 220 drives the transistor 128 to stabilise the common base voltage of the transistors 214 and 216 to a value such that the currents are equal in transistors 214 and 216. The voltage divider formed by resistors Rx and R1 ensures that the voltage Vbe appearing across the base-emitter of the transistor 214 is multiplied by a chosen factor K to produce Vout=Vbg*(Rx+R1)/R1, where Vbg is the voltage between the node 112 and ground. In the example shown, the factor K is again chosen to be 4.17, multiplying the voltage Vbg for Silicon transistors of 1.2 volts so that Vout equals 5.0 volts.

The Brokaw band-gap circuits shown in FIGS. 1 and 2 exhibit good stability and accuracy compared with other known circuits but still suffer from residual process variability and temperature drift. For example, the double base currents flowing in the resistor R1 are affected by the dispersion due to manufacturing process variability, and variation with temperature, of the gains (beta) of the transistors 114, 116 and 214, 216. Compensation of these base current dispersion and variation is complicated, involves additional circuitry and is likely to increase current consumption, for example if current through the resistor bridge Rx, R1 is increased to mask the variability of the base currents. In addition, mismatch in the current mirror affects the variation with temperature of the voltage appearing across the resistor 124, 224 and hence the stability of the output reference voltage with temperature.

Figure 3:
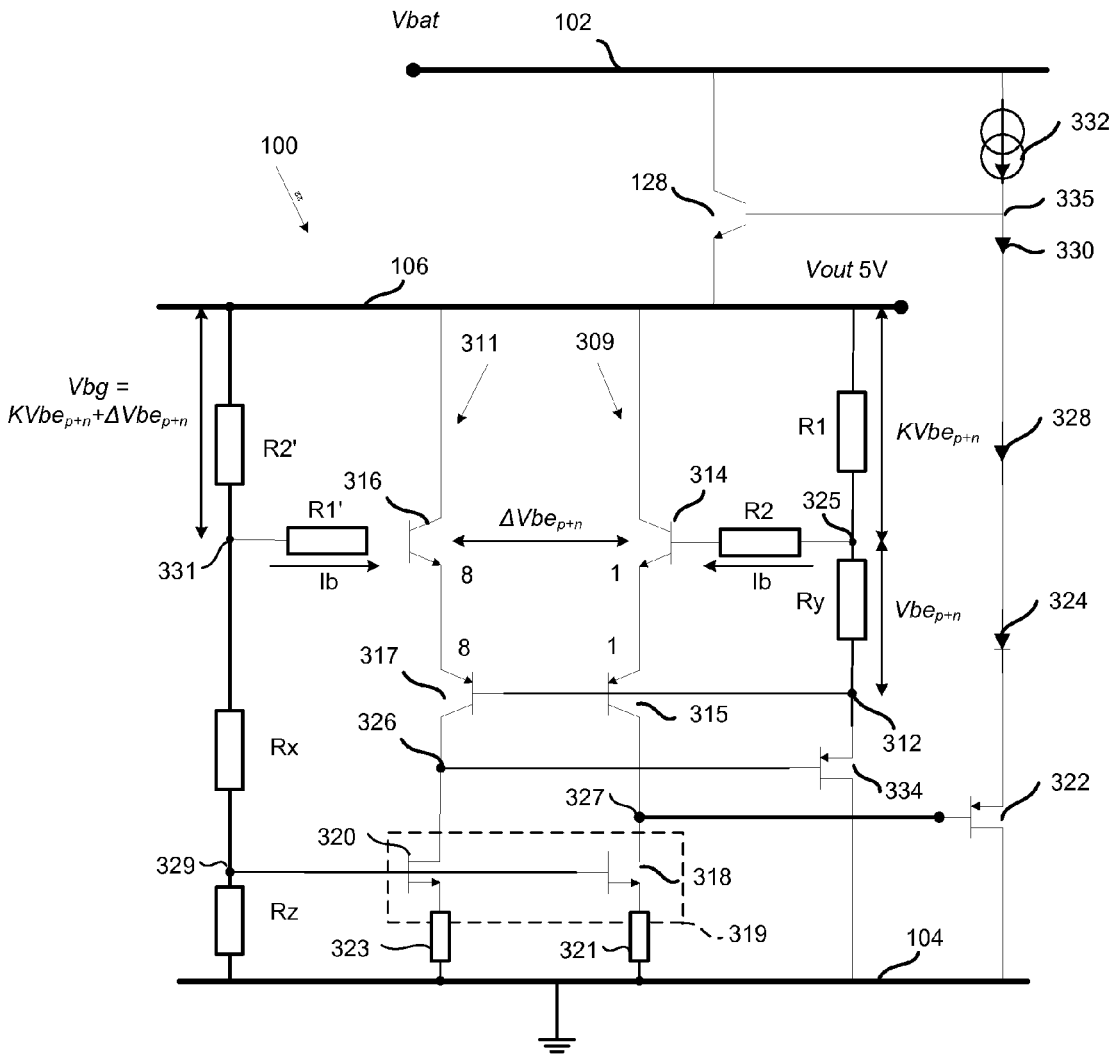
FIG. 3 is a schematic diagram of a band gap reference voltage circuit in accordance with an embodiment of the invention, given by way of example.

An embodiment of the present invention is shown in FIG. 3, in which certain elements similar to those of the preceding Figures of the drawings have the same references. This embodiment of the invention comprises an output section 100 having first and second branches 309 and 311 extending from the output rail 106 to a current source 319 connected to ground 104. The first branch 309 comprises a group of transistors, consisting in this example of a pair comprising an npn-type bipolar transistor 314 and a pnp bipolar transistor 315 connected with their emitter-collector paths in series. The collector of the npn transistor 314 is connected to the output rail 106 and its emitter is connected to the emitter of the pnp transistor 315. The second branch 311 comprises a similar group consisting of an npn-type bipolar transistor 316 and a pnp bipolar transistor 317 connected with their emitter-collector paths in series. The transistors 314 and 315 of the first branch 309 have emitter current densities substantially higher than the emitter current densities of the second branch 311, in this case by a factor of 8 to 1.

The current source 319 includes n-type FETs 318 and 320 whose source-drain paths are connected in series with the branches 309 and 311 respectively, the drains of the FETs 318 and 320 being connected to the collectors of the transistors 315 and 317 respectively. The sources of FETs 318 and 320 are connected to ground 104 through respective resistors 321 and 322, so that the source-drain paths of the FETs present current conduction paths controlling the current flow in the branches 309 and 311 respectively. The gates of the FETs 318 and 320 are control electrodes for the current conduction paths and are coupled by common connection to a node 329, so that equal currents flow in the branches 309 and 311. Consequently, the series-connected pairs of transistors 314, 315 of the first branch and 316, 317 of the second branch run at different emitter current densities due to the different emitter areas, by a factor of 8 in the example given. Specifically, the node 329 is connected through a resistor Rz to ground 104 and is also connected through a resistor Rx to a node 331, which is connected through a resistor R2' to the output rail 106. A bias voltage appears at the node 329, which is connected to the gates of both the FETs 318 and 320.

A node 312 is connected to the bases of both the pnp transistors 315 and 317. The node 312 is connected through a resistor Ry to a node 325, which is connected through a resistor R1 to the output rail 106 and limits the voltage across the resistors R1 and Ry, applied across the first and second pairs of transistors 314 to 317. A p-type FET 334 has its source-drain path connected between the node 312 and ground 104 and its gate connected to a node 326 between the collector of the transistor 317 and the drain of the FET 320 of the current source 319 in the branch 311 of lower current density. The FET 334 forms the voltage limiting element.

The node 325 is connected through a resistor R2 to the base of the npn transistor 314. The node 331 is connected through a resistor R1' to the base of the npn transistor 316. The resistors R1 and R1' have the same value and the resistors R2 and R2' have the same value. The nodes 325 and 331 bias the gates of the transistors 314 and 316 respectively, which are connected in series with the voltage limited transistors 315, 317.

A node 327 in the branch 309 of higher current density, connected to the drain of the FET 318 and the collector of the transistor 315, is connected to the gate of a p-type FET 322, whose drain is connected to ground 104 and whose source is connected through the series connection of three diodes 322, 328 and 330 and a node 335 to a current source 332, which is connected in turn to the output rail 106. The node 335 is connected to the base of an npn transistor 128 whose collector is connected to the battery rail 102 and whose emitter is connected to the output rail 106. The transistor 128 controls the flow of current from the supply rail 102 in response to the voltage at the node 327 between the current source 319 and the pair of transistors in the branch 309 of higher emitter current density, whereby to regulate the voltage at the output terminal 106.

A suitable start-up circuit (not shown) is coupled with the output circuit 100 of FIG. 3, for example at node 312, to ensure reliable starting of the output circuit.

In normal operation, the transistor 128 provides current through the resistors R2', Rx and Rz to bias control electrodes, which are the gates of the FETs 318 and 320, the FETs conducting sufficiently to pull their drain voltages down and for their source voltage to rise close to the bias voltage. Their source-drain currents are therefore defined by the bias voltage at the node 329 and the resistors 321 and 323, which are chosen to be equal, so as to produce equal currents in the two branches 309 and 311.

The voltage at the node 326 is applied to the gate of the FET 334, which conducts to pull down the voltage of the node 312 connected to its source. This voltage is applied to the bases of the transistors 314 to 317 causing the collector currents of the transistors 315 and 317 to rise sufficiently for their base-emitter voltages $Vbe_p$ to exceed their threshold voltage. Their collector currents stabilise at the value defined by the resistors 321 and 323. The voltage at the node 326 stabilises at a value where the voltage $Vbe_{p+n}$ between the nodes 312 and 325, applied to the resistor Ry, is equal to the sum of the base-emitter voltages $Vbe_n$ and $Vbe_p$ of the transistors 314 and 315, apart from a correction introduced by the resistor R2 for the effect of the base current of the transistor 314.

The coupled current sources formed by FETs 318 and 320 adjust the voltage at the node 327, applied to the FET 322. The FET322 draws current from the current source 332 through the forward biased diodes 324, 328 and 330, introducing voltage drops to compensate for the base-emitter voltages of the transistors 315/317, 314/316 and the transistor 128. The voltage at the node 335 adjusts to a value that drives the transistor 128 to stabilise the voltages at the nodes 325 and 331, and hence the base voltages of the transistors 314 and 316, to values such that the currents are equal in transistors 314 and 316 and equal to the value defined by the resistors 321 and 323.

The transistors 314 and 315 of the first branch 309 have a smaller emitter area than the transistors 316 and 317 of the second branch 311, by a factor of 8 in this example. Since the emitter currents in the two branches are the same, the emitter current density is higher in the two transistors of the first branch 309 and the cumulated base-emitter voltage across the higher current density base-emitter junctions of the two transistors of the first branch 309 is higher than the cumulated base-emitter voltage across the lower current density base-emitter junctions of the two transistors of the second branch 311, the difference being denoted by $\Delta Vbe_{p+n}$.

The current flowing in the resistors R1 and Ry from the output rail 106 to the node 325 is the same, apart from a small correction due to the base-emitter current of the transistor 314 flowing in the resistor R1. The voltage divider formed by resistors Ry and R1 ensures that the voltage V1 across the resistor R1 is equal to the cumulated voltage $Vbe_{p+n}$ appearing across the series connection of the base-emitter junctions of the npn and pnp transistors 314 and 315 multiplied by a chosen factor K=R1/Ry to produce V1=$Vbe_{p+n}$*R1/Ry. The base-emitter voltages $Vbe_n$ and $Vbe_p$ of each of the npn and pnp transistors 314 and 315 are substantially identical and in the example shown, the cumulated base-emitter voltage $Vbe_{p+n}$ across the series combination of both the npn and pnp transistors 314 and 315 adjusts to a value equal to a band-gap voltage for Silicon transistors of 1250 mV and the factor K=R1/Ry is chosen to be 1/10, dividing the cumulated voltage across the two transistors of 1250 mV so that V1 equals 125 mV.

The difference in emitter current densities between the transistor pairs produces the difference in base-emitter voltages between the pair 314, 315 of the first branch 309 and the pair 316, 317 of the second branch 311, so that the cumulated difference $\Delta Vbe_{p+n}$ in base-emitter voltages between the branch 309 and the branch 311 is approximately 125 mV in this example.

In more detail, the cumulated difference $\Delta Vbe_{p+n}$ in base-emitter voltages between the branch 309 and the branch 311 is given approximately by:

$$\Delta Vbe_{p+n} = 2\frac{kT}{q}\log_n \frac{J309}{J311},$$

where k is the Boltzmann constant, T is the absolute temperature, q is the fundamental electron charge and J309 and J311 are the respective emitter current densities of the transistors in the branches 309 and 311, the emitter junction current density in the branch 309 being chosen to be 8 times that of the branch 311 in the example shown. The voltage difference Vbg appearing across the resistor R2' at node 331 is the sum of the voltage $\Delta Vbe_{p+n}$ approximately 125 mV at room temperature and which varies positively with temperature, and the voltage $KVbe_{p+n}$ across the resistor R1, derived from the cumulated base-emitter voltage $Vbe_{p+n}$ between the nodes 312 and 325, across the resistor Ry, also approximately 125 mV at room temperature in the example shown and which varies negatively with temperature, so that $$Vbg = KVbe_{p+n} + 2\frac{kT}{q}\log_n \frac{J309}{J311}.$$

The negative coefficient of temperature variation of the voltage $Vbe_{p+n}$ (in this example approximately −0.4 mV/° K) cancels the positive coefficient of temperature variation of the voltage difference $\Delta Vbe_{p+n}$ (in this example approximately +0.4 mV/° K), to a first order of approximation. The voltage Vbg, and hence the voltage Vout is thus regulated to be substantially independent of variations in power supply voltage Vbat.

The voltage divider formed by the resistors R2', Rx and Rz is chosen to give a suitable value for Vout and the voltage Vout at the output rail 106 stabilises at $$Vout = \frac{(R2' + Rx + Rz)}{R2'}Vbg.$$

In the present example these values are chosen so that Vout=5 volts, although other values can be obtained.

The resistors R1' and R2' have the same values as the resistors R1 and R2 respectively, so that the effect on Vbg of the base currents Ib flowing in the resistors R1 and R2' are cancelled out by the base currents Ib flowing in the resistors R1' and R2. All the resistors present resistances that vary similarly with temperature, so that their ratio remains constant independently of temperature, and the operational bias voltages that the resistors generate do not vary significantly with temperature. The bias current and voltage are independent of the transistor band-gap voltages.

The production dispersion of characteristics due to base current dispersion in the standard Brokaw circuit, notably due to production dispersion of the current gain of the transistors can be avoided or at least reduced in this embodiment of the invention since the band-gap voltage Vbg is a function of the cumulated base-emitter voltage across two transistors of opposite type, a pnp and an npn with their base-emitter junctions connected in series and their emitter-collector paths in series. The cumulated voltage $Vbe_{p+n}$ across each pair of transistors is the average of the base-emitter voltages of the two transistors of the pair, which statistically reduces the dispersion of the cumulated voltages. This applies to the dispersion of the value of Vbg and also to the dispersion of its rate of variation with temperature.

In the standard Brokaw circuit, errors are introduced by mismatch of the mirror currents of the FETs 118, 120 or 218, 220, which appear as a dispersion of the characteristics of the voltage regulator in production. Such errors due to mismatch of the FETs 318, 320 of this embodiment of the invention are negligible, since the node 312 drives the common base voltage of the transistors 315 and 317 in the branches 309 and 311 and the node 329 drives the common gate voltage of the FETs 318 and 320.

In a specimen of a standard Brokaw circuit the 5 sigma dispersion of the output voltage Vout, nominally 5 volts, is 52 mV while in a specimen of an embodiment of the present invention as shown in FIG. 3, made by similar production processes and with similar materials, the 5 sigma dispersion of the output voltage Vout, also nominally 5 volts, is 12 mV. Of this reduction in dispersion, the elimination of the consequences of current mirror mismatch accounts for 35 mV.

Figure 4:
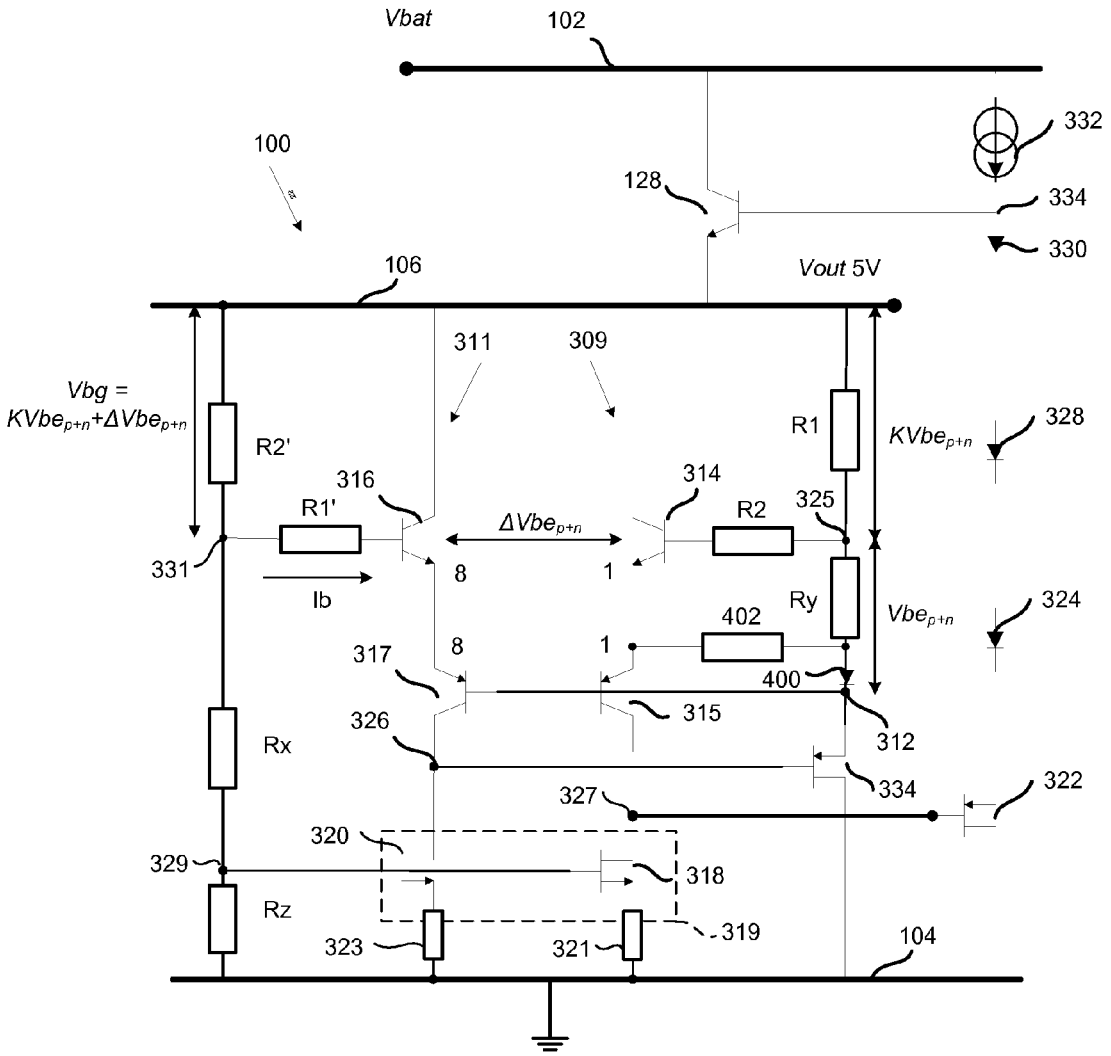
FIG. 4 is a schematic diagram of a band gap reference voltage circuit in accordance with another embodiment of the invention, given by way of example.

FIG. 4 shows a variation on the circuit of FIG. 3 that reduces the residual second order variation of the coefficient of temperature variation of the voltage difference $\Delta Vbe_{p+n}$ by adding a forward biased diode 400 or other PN junction in series with the resistor Ry between the nodes 312 and 325 and a resistor 402 connected between the connection between the diode 400 and the resistor Ry on one side and the connection between the emitters of the transistors 314 and 315 on the other side.

Figure 5:
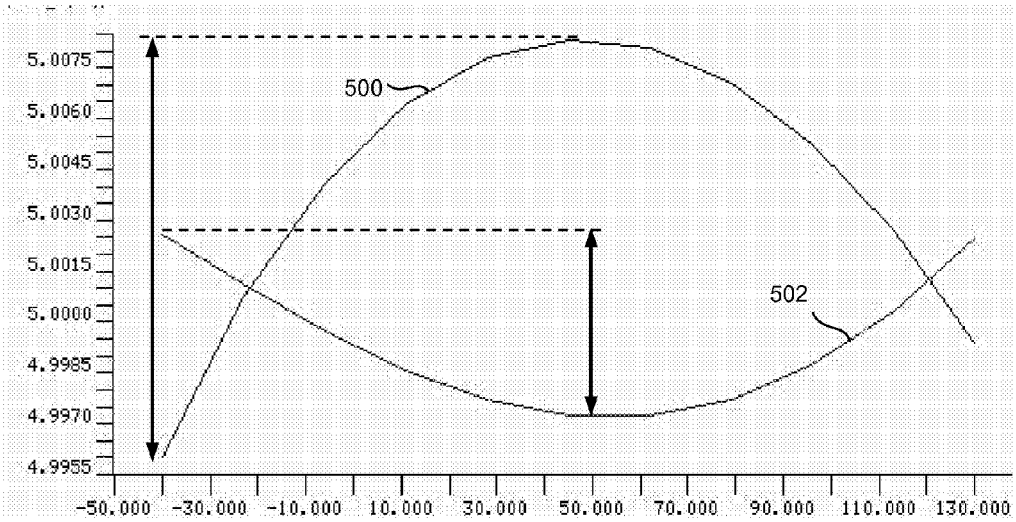
FIG. 5 is a diagram of an output voltage as a function of temperature in the band gap reference voltage circuits of FIGS. 3 and 4.

FIG. 5 shows the effects on the output voltage Vout as a function of operating temperature at 500 for the configuration of FIG. 3, and at 502 for the configuration of FIG. 4 with the addition of the diode 400. It will be seen that a substantial degree of compensation of the second order variation is obtained.

Figure 6:
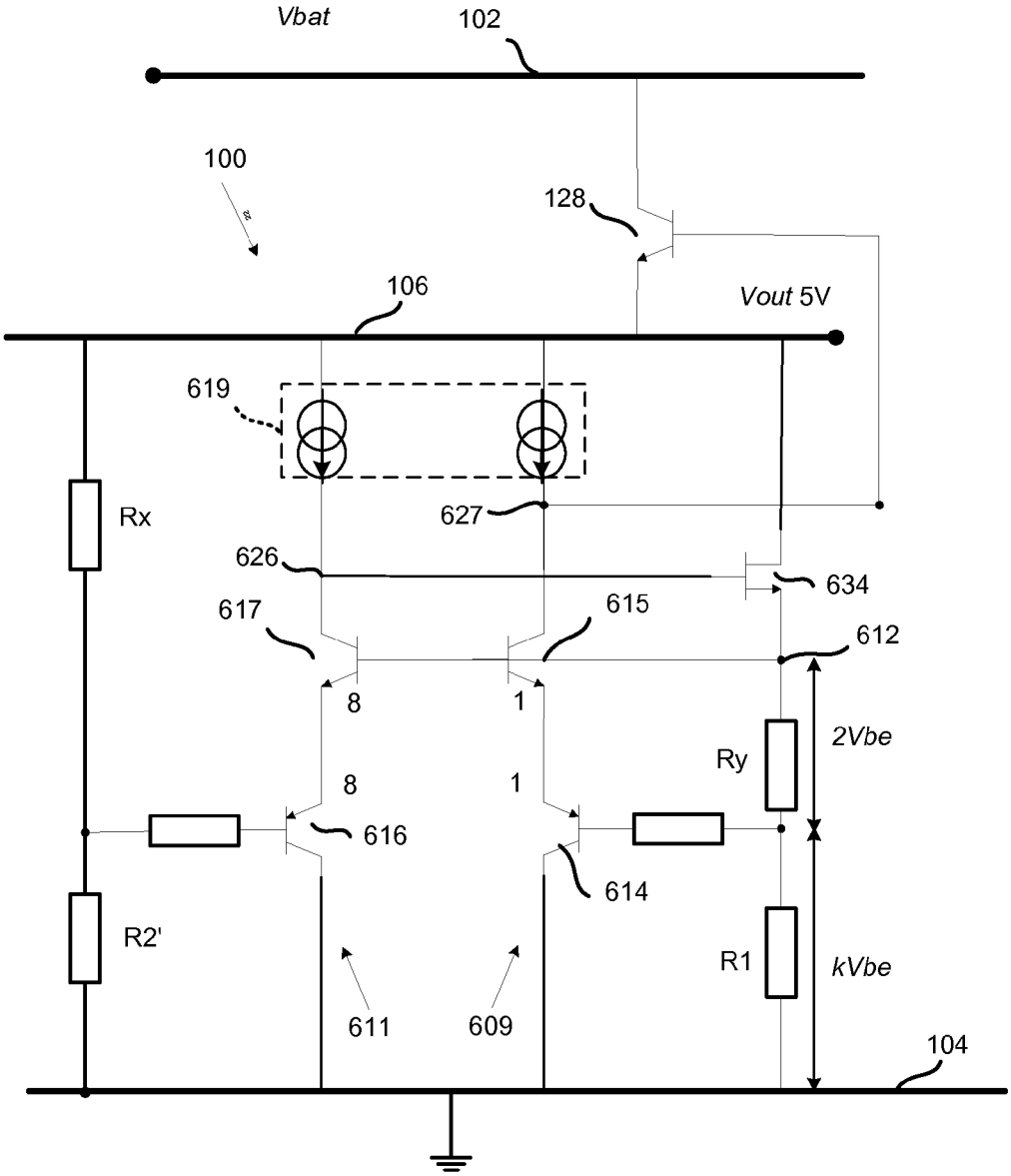
FIG. 6 is a schematic diagram of a band gap reference voltage circuit in accordance with yet another embodiment of the invention, given by way of example.

FIG. 6 of the drawings shows another embodiment of the present invention in a configuration inverted relative to that of FIGS. 3 and 4, analogous to the configuration of the prior art circuit of FIG. 1. The embodiment of the invention shown in FIG. 6 comprises a band-gap voltage reference output circuit 100 comprising first and second branches 609 and 611 respectively including first and second groups of transistors of different emitter current conduction areas. Current sources 619 are connected for running the first and second groups of transistors at the same current but different emitter current densities. The output voltage on line 106 is responsive to a difference between the branches 609 and 611 of base-emitter voltages of the first and second groups of transistors and to a base-emitter voltage of at least one transistor of that one of the first and second groups with higher emitter current density.

In this embodiment of the invention, the first and second groups comprise pairs of transistors having one npn-type transistor 615, 617 and one pnp transistor 614, 615 respectively. The transistors of each pair are connected with their emitter-collector paths in series in the respective one of the branches 609, 611 so as to present cumulated base-emitter voltages across the respective pair. The current source 619 is connected between the collectors of the transistors 615, 617 and the output line 106 and the collectors of the transistors 614, 616 are connected to ground 104. A node 627 between the collector of transistor 626 and the current source 609 is connected to the base of transistor 128 which supplies the output line 106 from the battery line 102. As in the circuit of FIGS. 3 and 4, the output voltage is responsive both to a difference between the cumulated base-emitter voltages of the first and second branches 609 and 611 and to the cumulated base-emitter voltage of the first branch 609 with higher emitter current density.

The embodiments of the invention shown in FIGS. 3, 4 and 6 have low quiescent current characteristics, in one example of 1.5 μA, and the bias currents for the current sources 319 and 619 are generated by resistive voltage dividers. In another embodiment of the invention, a reference current source is used to pilot the current sources such as 319 or 619 and whose variation with temperature and production dispersion can be reduced, with a small penalty in quiescent current.

The invention claimed is:

1. A band-gap voltage reference circuit comprising: a first branch including a first group of transistors and a first transistor of a current source, each transistor of the first group of transistors having first emitter current conduction areas, each transistor of the first group of transistors including at least one npn-type transistor and at least one pnp-type transistor connected with their emitter-collector paths in series in the first branch so as to present cumulated base-emitter voltages across the first group, and each transistor of the first group being connected in series with a current conduction path of the first transistor of the current source; and a second branch including a second group of transistors and a second transistor of the current source, each transistor of the second group having second emitter current conduction areas different than the first emitter current conduction areas, each transistor of the second group of transistors including at least one npn-type transistor and at least one pnp-type transistor connected with their emitter-collector paths in series in the second branch so as to present cumulated base-emitter voltages across the second group, and each transistor of the second group being connected in series with a current conduction path of the second transistor of the current source, the current source for running said first and second groups of transistors at different emitter current densities to generate respective base-emitter voltages, and output terminals connected to receive a regulated voltage which is a function of said base-emitter voltages of said first and second groups of transistors, wherein the output voltage at said output terminals being responsive both to a difference between said cumulated base-emitter voltages of said first and second branches and to the cumulated base-emitter voltage of that one of said first and second groups with higher emitter current density, and wherein said first and second branches include respective voltage dividers connected to bias respective transistors of said first and second groups, which are connected in series with said voltage limited transistors.

2. A band-gap voltage reference circuit as claimed in claim 1, wherein said output terminals are connected to receive current from a supply through an element responsive to a voltage at a node between said current source and said group of transistors in said branch of higher emitter current density, whereby to regulate the voltage at said output terminals.

3. A band-gap voltage reference circuit as claimed in claim 1, wherein the first and second transistors of the current source are connected so as to cause the same value of current to flow in said first and second groups of transistors.

4. A band-gap voltage reference circuit as claimed in claim 3, wherein the first and second transistors of the current source have a common control electrode connection.

5. A band-gap voltage reference circuit as claimed in claim 1, and including a forward biased PN junction connected in series with said voltage divider connected to transistors of said branch of higher emitter current density, whereby to tend to compensate second order variations with temperature in the voltage at said output terminals.

6. A band-gap voltage reference circuit as claimed in claim 1, and including a reference current source for piloting said current source.

7. A band-gap voltage reference circuit as claimed in claim 2, wherein the first and second transistors of said current source are connected so as to cause the same value of current to flow in said first and second groups of transistors.

8. A band-gap voltage reference circuit as claimed in claim 7, wherein the first and second transistors of the current source have a common control electrode connection.

9. A band-gap voltage reference circuit as claimed in claim 2, wherein said first and second branches include respective voltage dividers connected to bias respective transistors of said first and second groups, which are connected in series with said voltage limited transistors.

10. A band-gap voltage reference circuit as claimed in claim 3, wherein said first and second branches include respective voltage dividers connected to bias respective transistors of said first and second groups, which are connected in series with said voltage limited transistors.

11. A band-gap voltage reference circuit as claimed in claim 4, wherein said first and second branches include respective voltage dividers connected to bias respective transistors of said first and second groups, which are connected in series with said voltage limited transistors.

12. A band-gap voltage reference circuit as claimed in claim 2 and including a reference current source for piloting said current sources.

* * * * *